US009793631B1

(12) United States Patent
Miller et al.

(10) Patent No.: US 9,793,631 B1
(45) Date of Patent: Oct. 17, 2017

(54) FLEXIBLE CIRCUIT TO WIRE TRANSITION MEMBER AND METHOD

(71) Applicants: TYCO ELECTRONICS CORPORATION, Berwyn, PA (US); TYCO ELECTRONICS UK LTD., Wiltshire, England (GB)

(72) Inventors: Keith Edwin Miller, Manheim, PA (US); Kyle Gary Annis, Hummelstown, PA (US); Eric Douglas Springston, II, Hershey, PA (US); Mitchell Kunane Storry, Harrisburg, PA (US); Robert John William Hudd, Gloucester (GB); Jonathan Mark Eyles, Wiltshire (GB); Philip James Hammond, Wiltshire (GB)

(73) Assignees: TE CONNECTIVITY CORPORATION, Berwyn, PA (US); TYCO ELECTRONICS UK LTD., Wiltshire (GB)

( * ) Notice: Subject to any disclaimer, the term of this patent is extended or adjusted under 35 U.S.C. 154(b) by 0 days.

(21) Appl. No.: 15/270,148

(22) Filed: Sep. 20, 2016

(51) Int. Cl.

| | |
|---|---|
| ***H01R 12/63*** | (2011.01) |
| ***H01R 4/02*** | (2006.01) |
| ***H01R 13/03*** | (2006.01) |
| ***H01R 43/02*** | (2006.01) |
| ***H01R 13/504*** | (2006.01) |
| ***H01R 43/20*** | (2006.01) |
| ***H01R 43/24*** | (2006.01) |

(52) U.S. Cl.
CPC ..... *H01R 12/63* (2013.01); *H01R 4/023* (2013.01); *H01R 4/027* (2013.01); *H01R 13/03* (2013.01); *H01R 13/504* (2013.01); *H01R 43/0221* (2013.01); *H01R 43/0263* (2013.01); *H01R 43/205* (2013.01); *H01R 43/24* (2013.01)

(58) Field of Classification Search
CPC ..... H01R 12/81; H01R 12/63
USPC ..... 174/88 R
See application file for complete search history.

(56) References Cited

U.S. PATENT DOCUMENTS

| | | | | | |
|---|---|---|---|---|---|
| 4,579,404 | A * | 4/1986 | Lockard | H01R 12/75 | 439/497 |
| 5,122,077 | A * | 6/1992 | Maejima | H01R 13/514 | 439/398 |
| 5,821,465 | A * | 10/1998 | Tanaka | H01R 12/61 | 174/117 F |
| 6,023,022 | A * | 2/2000 | Nakamura | H01R 12/63 | 174/117 F |

* cited by examiner

*Primary Examiner* — Ross Gushi

(57) ABSTRACT

A flexible circuit to wire transition member and method which transitions wires connected to a standard wire termination connector to a flexible circuit. The transition member includes a housing with a flexible circuit receiving recess provide proximate a first surface of the housing. A wire receiving recess is provided in the housing proximate a first surface of the housing. A contact extends between the flexible circuit receiving recess and the wire receiving recess, the contact provides an electrical connection between a flexible circuit received in the flexible circuit receiving recess and a wire received in the wire receiving recess.

18 Claims, 6 Drawing Sheets

FLEXIBLE CIRCUIT TO WIRE TRANSITION MEMBER AND METHOD

FIELD OF THE INVENTION

The present invention relates to an apparatus and method for connecting wires to a flexible circuit. In particular, the invention is directed to a method and apparatus which transitions wires connected to a standard wire termination connector to a flexible circuit.

BACKGROUND OF THE INVENTION

Many electrical connectors manufactured and used include terminals which are designed to be terminated to wires through the use of crimping, insulation displacement or other know techniques. These standardized wire termination connectors are widely known and used in many industries. However, in many applications, the wires extending from the connectors can add unwanted weight in an environment in which reduced weight is desirable. In addition, multiple wires may be difficult to bend or conform to small spaces, thereby requiring additional space to be required to allow for proper routing of the wires. However, in many applications, as space is at a premium, it would be beneficial to minimize the space required for routing of the wires.

Flexible circuits use a flexible plastic substrate having printed circuits thereon. The flexible plastic substrate is capable of being routed while being conformed to a desired shape or flexed during use. While the use of flexible circuits would prove beneficial in many applications, the use of flexible circuits is limited as the flexible circuits cannot be terminated to the standardized wire termination connectors.

It would, therefore, be beneficial to provide an apparatus and method which would allow for the use of flexible circuits with standardized wire termination connectors.

SUMMARY OF THE INVENTION

An object is to transition wires connected to a standard wire termination connector to a flexible circuit.

An embodiment is directed to a flexible circuit to wire transition member, the transition member includes a housing with a flexible circuit receiving recess provided proximate a first surface of the housing. A wire receiving recess is provided in the housing proximate a first surface of the housing. A contact extends between the flexible circuit receiving recess and the wire receiving recess, the contact provides an electrical connection between a flexible circuit received in the flexible circuit receiving recess and a wire received in the wire receiving recess.

In various embodiments, the transition member includes a contact receiving recess which extends between the flexible circuit receiving recess and the wire receiving recess. The contact receiving recess is configured to receive the contact therein.

In various embodiments, the transition member includes potting compound which is provided the flexible circuit receiving recess, the wire receiving recess and the contact receiving recess to retain the flexible circuit, wire and contact in position relative to the housing.

In various embodiments, the transition member includes a second flexible circuit receiving recess and second wire receiving recess are provided in the housing, the second flexible circuit receiving recess and second wire receiving recess are provided proximate a second surface of the housing which is opposed to the first surface of the housing.

In various embodiments, the contact receiving recesses proximate the flexible circuit receiving recess are spaced apart a first distance and the contact receiving recesses proximate the wire receiving recess are spaced apart a second distance, the first distance being different than the second distance.

In various embodiments, the transition member includes stacking members which cooperate with stacking members provided on a housing of another transition member to allow the housings of the transition members to be joined.

An embodiment is directed to a method of terminating a connector to a flexible circuit. The method includes: terminating wires to contacts in a connector; positioning the wires in wire receiving recesses of a housing of transition member, the housing having contacts extending between the wire receiving recesses and a flexible circuit receiving recess; positioning a flexible circuit in the flexible circuit receiving recess; terminating the wires to the contacts; and terminating the flexible circuit to the contacts. The electrical signals are directed between the wires and the flexible circuit through the contact of the transition member.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
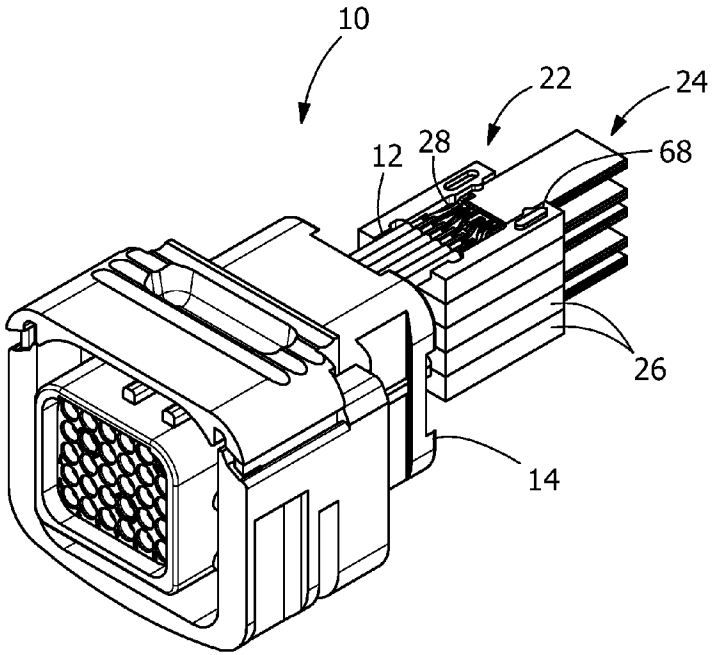
FIG. 1 is a perspective view of an electrical connector with illustrative flexible circuit to wire transition members electrically connected to the electrical connector.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Many electrical connectors manufactured and used include terminals which are designed to be terminated to wires through the use of crimping, insulation displacement or other know techniques. While the use of flexible circuits would prove beneficial in many applications, the use of flexible circuits is limited as the flexible circuits cannot be terminated to the standardized wire termination connectors. The invention is, therefore, directed to a method and apparatus which transitions wires connected to a standard wire termination connector to a flexible circuit.

As shown in FIG. 1, an electrical connector 10 has wires 12 which are connected to terminals (not shown). The wires 12 extend from a rear end 14 of the connector 10. The wires 12 have insulation 16 which surround conductors 18. Ends 20 of the wires 12 which are removed from the connector 10 have exposed conductors 18. While individual wires 12 are shown, the wires may be replaced with ribbon cable or the like. In addition, the connector 10 can be of the type shown in FIG. 1 or can have any other configuration in which terminals are designed to be terminated to wires through the use of crimping, insulation displacement or other know techniques.

Referring to FIGS. 1 through 4, transition member 22 provides a transition between the wires 12 and a flexible circuit 24, thereby allowing electrical signals to flow from the flexible circuit 24 across the transition member 22 to the wires 12 and to the terminals of the electrical connector 10.

Figure 3:
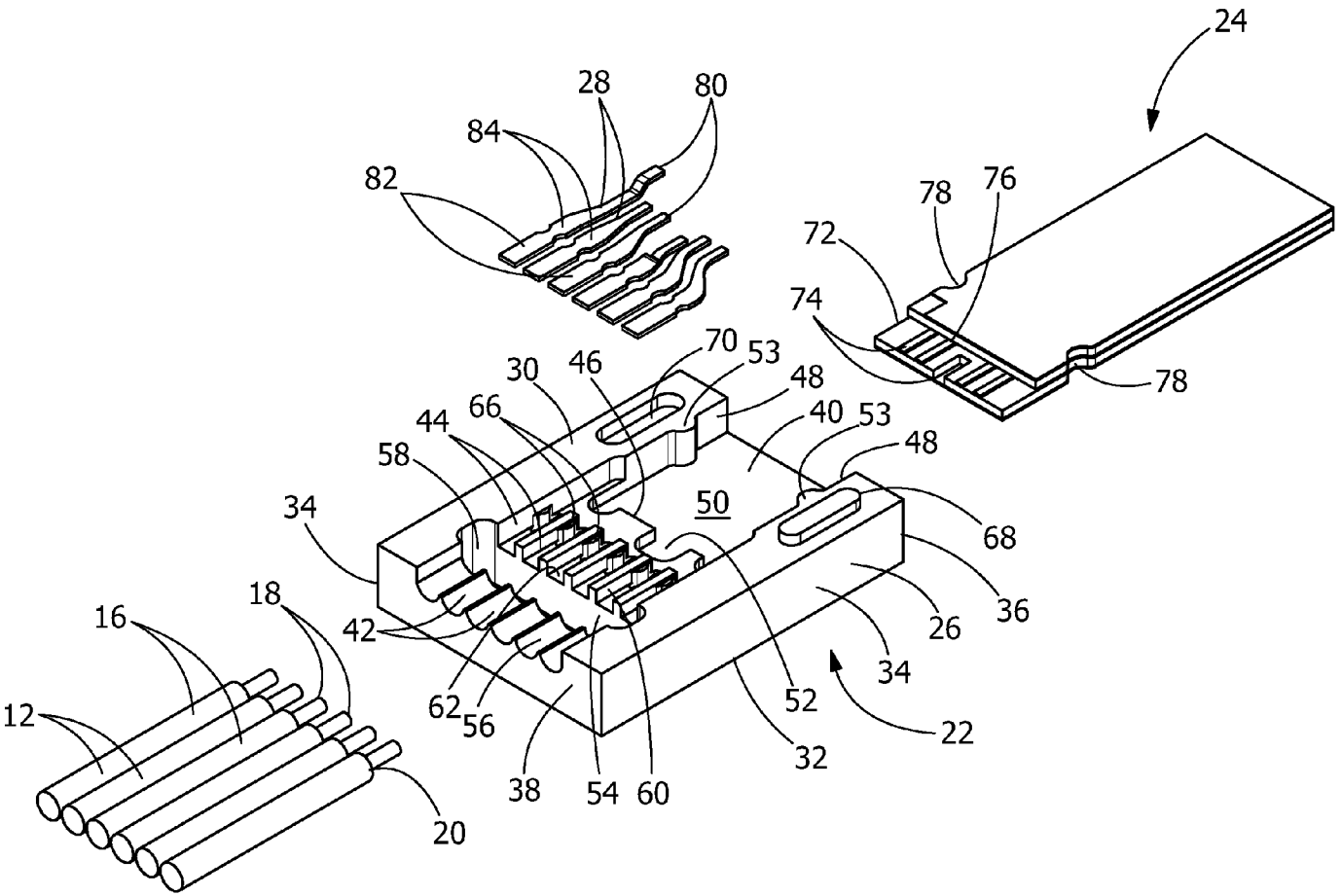
FIG. 3 is a perspective view of the flexible circuit to wire transition member of FIG. 2 with a flexible circuit, wires and contacts exploded from a housing.

Transition member 22 has a housing 26 with contacts 28 provided therein. As best shown in FIG. 3, the housing has a top or first surface 30, an oppositely facing bottom or second surface 32, sidewalls 34, a flexible circuit receiving face 36 and a wire receiving face 38. The housing has a flexible circuit receiving recess 40, wire receiving recesses 42 and contact receiving recesses 44 which extend between the flexible circuit receiving recess 40 and the wire receiving recess 42.

The flexible circuit receiving recess 40 extends from the flexible circuit receiving face 36 toward the wire receiving face 38, and extends from the first surface 30 toward the second surface 32. The flexible circuit receiving recess 40 has a front surface 46, side surfaces 48 and a bottom surface 50. The front surface 46, side surfaces 48 and bottom surface 50 cooperate with flexible circuit 24 to properly position the flexible circuit in the flexible circuit receiving recess 40 and in the housing 26 of the transition member 22. In the embodiment shown, contact receiving recesses 52 may extend from the front surface 46. Flexible circuit retention members 53 extend from the side surfaces 48 into the flexible circuit receiving recess 40.

The wire receiving recesses 42 extend from the wire receiving face 38 toward the flexible circuit receiving face 36, and extend from the first surface 30 toward the second surface 32. The wire receiving recesses 42 have front surfaces 54 and arcuately shaped bottom surface 56. The front surfaces 54 and bottom surfaces 56 cooperate with wires 12 to properly position the wires in the wire receiving recesses 42 and in the housing 26 of the transition member 22. In the embodiment shown, a slot 58 is provided proximate the front surfaces 54 and extends across multiple wire receiving recesses 42.

The contact receiving recesses 44 extend between the flexible circuit receiving recess 40 and the wire receiving recess 42, and extend from the first surface 30 toward the second surface 32. The contact receiving recesses 44 have side surfaces 60 and bottom surfaces 62. The side surfaces 60 and bottom surfaces 62 cooperate with contacts 28 to properly position the contacts 28 in the contact receiving recesses 44 and in the housing 26 of the transition member 22. Contact retention members 66 extend from the side surfaces 60 into the contact receiving recesses 44. The bottom surfaces 62 of the contact receiving recesses 44 are raised relative to the bottom surface 56 of the wire receiving recesses 42. Alternatively, the bottom surfaces 62 of the contact receiving recesses 44 are lowered relative to the bottom surface 56 of the wire receiving recesses 42.

A transition member stacking projection 68 extends from the first surface 30 in a direction away from the second surface 32. A transition member stacking recess 70 extends from the first surface 30 in a direction toward the second surface 32.

Flexible circuit 24 has a mating end 72 with contact pads 74 of traces exposed through windows or cut outs 76. The contact pads 74 are exposed using laser ablation, micro-milling or other known methods. Retention member receiving recesses 78 are provided proximate the mating end 72.

Contacts 28 are made from any material having the conductive and strength characteristics required. Each contact 28 has a flexible circuit engagement portion 80, a wire engagement portion 82 and a transition portion 84. As the contact pads 74 of the flexible circuit 24 may have centerline spacing which is different from the centerline spacing of the wires 12, the each transition portion 84 may be configured differently to accommodate such spacing differences. The flexible circuit engagement portions 80 of the contacts 28 may also be positioned at different heights or in different horizontal planes to accommodate the different heights of the contact pads 74 of the flexible circuit which are used for shielding, grounding or the like.

Figure 2:
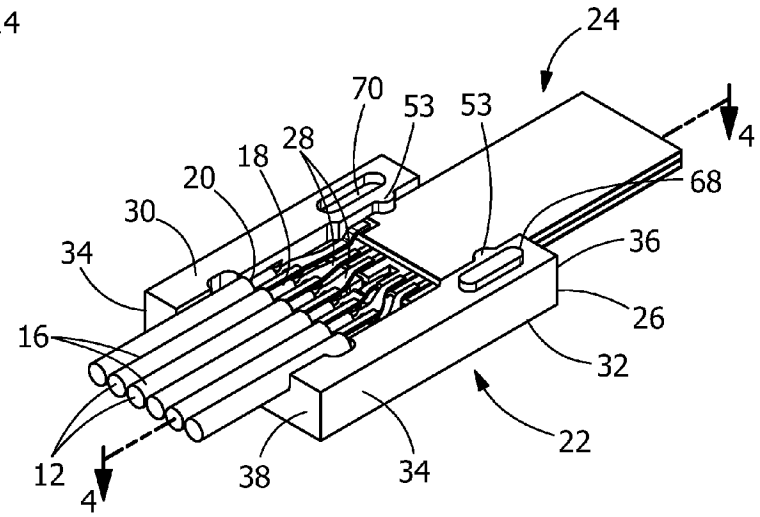
FIG. 2 is an enlarged perspective view of a single flexible circuit to wire transition member shown in FIG. 1.
Figure 4:
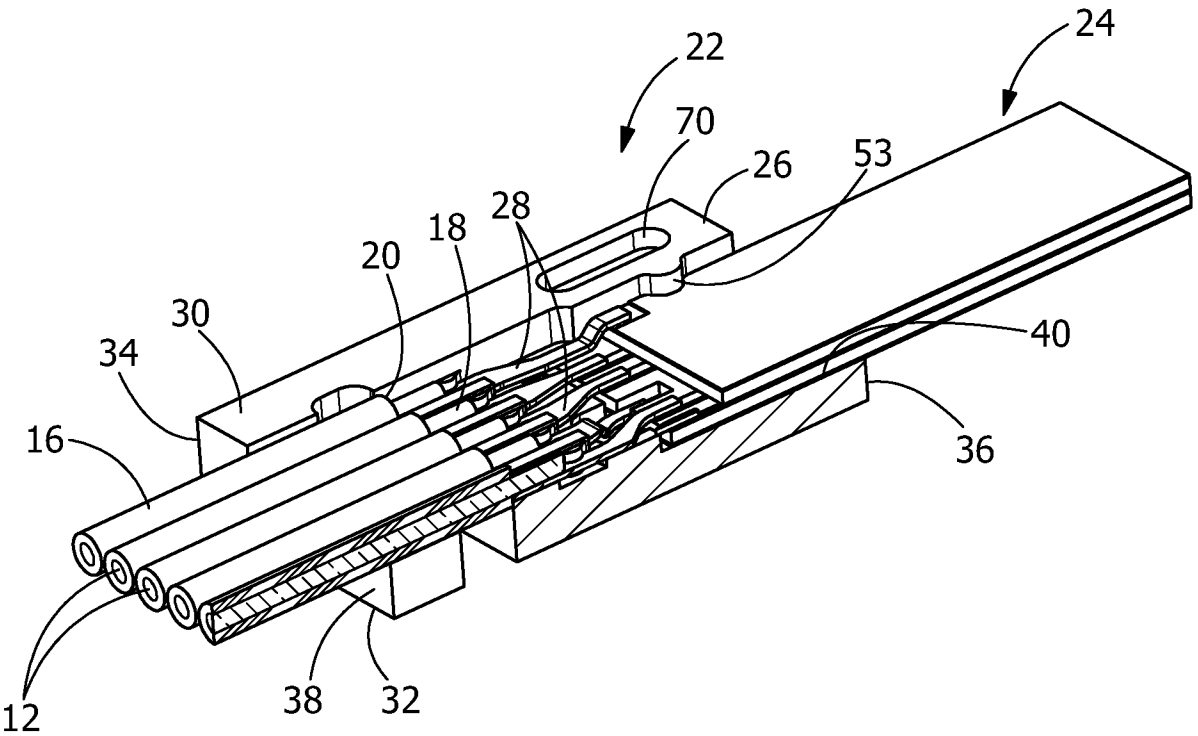
FIG. 4 is a perspective cross-sectional view of the flexible circuit to wire transition member taken along line 4-4 of FIG. 2.

Referring to FIGS. 2 and 4, when assembled, the flexible circuit 24 is positioned in the flexible circuit receiving recess 40 and is prevented from axial movement by the cooperation of the flexible circuit retention members 53 with the retention member receiving recesses 78. Contacts 28 are positioned in the flexible contact receiving recesses 44 and are prevented from axial movement by the cooperation of the contact retention members 66 with the transition portion 84. The flexible circuit engagement portion 80 are electrically and mechanically connected to the contact pads 74 by solder, laser welding or other know methods.

The wires 12 are positioned in the wire receiving recesses 42. The ends of the insulation 16 abut the front surfaces 54 to properly position the wires 12 in the wire receiving recesses 42. The conductors 18 of the wires 12 are electrically and mechanically connected to the contact engagement portions 82 by solder, laser welding or other know methods.

With the wires 12 and flexible circuit 24 properly connected to the contacts 28, a potting compound is applied to the flexible circuit receiving recess 40, the wire receiving recesses 42 and the contact receiving recesses 44 to properly secure the components in position and to properly seal the transition member 22. Alternatively, overmolding or other similar techniques may be applied to seal the transition member 22 and maintain the components in position.

As shown in FIG. 1, multiple transition members 22 may be stacked or joined together. In the embodiment shown, transition member stacking projection 68 of one transition member 22 cooperates with a transition member stacking recess 70 of another transition member 22 to provide an interference fit. However, other methods of joining the transition members 22 can be used, including, but not limited to, using an adhesive or enclosing the transition members 22 in a backshell. The stacked multiple transition members may be electromagnetically shielded.

Figure 5:
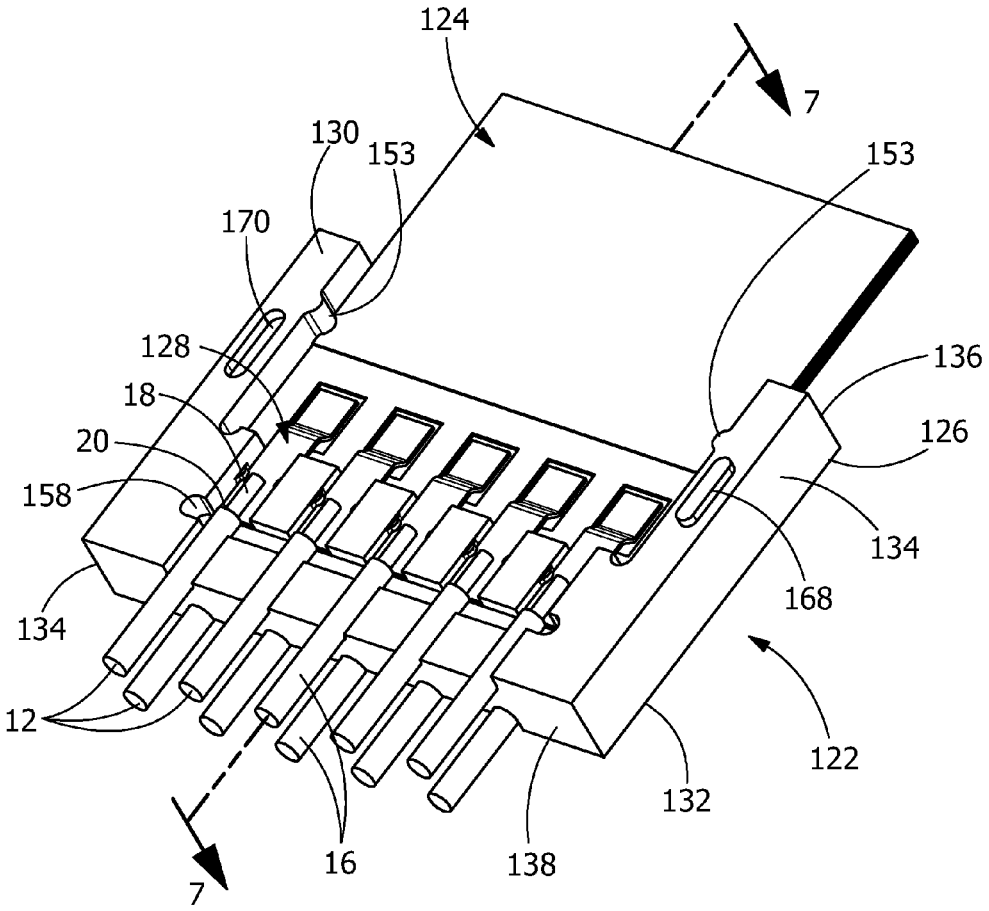
FIG. 5 is an enlarged perspective view of an alternate illustrative embodiment of a single flexible circuit to wire transition member.
Figure 6:
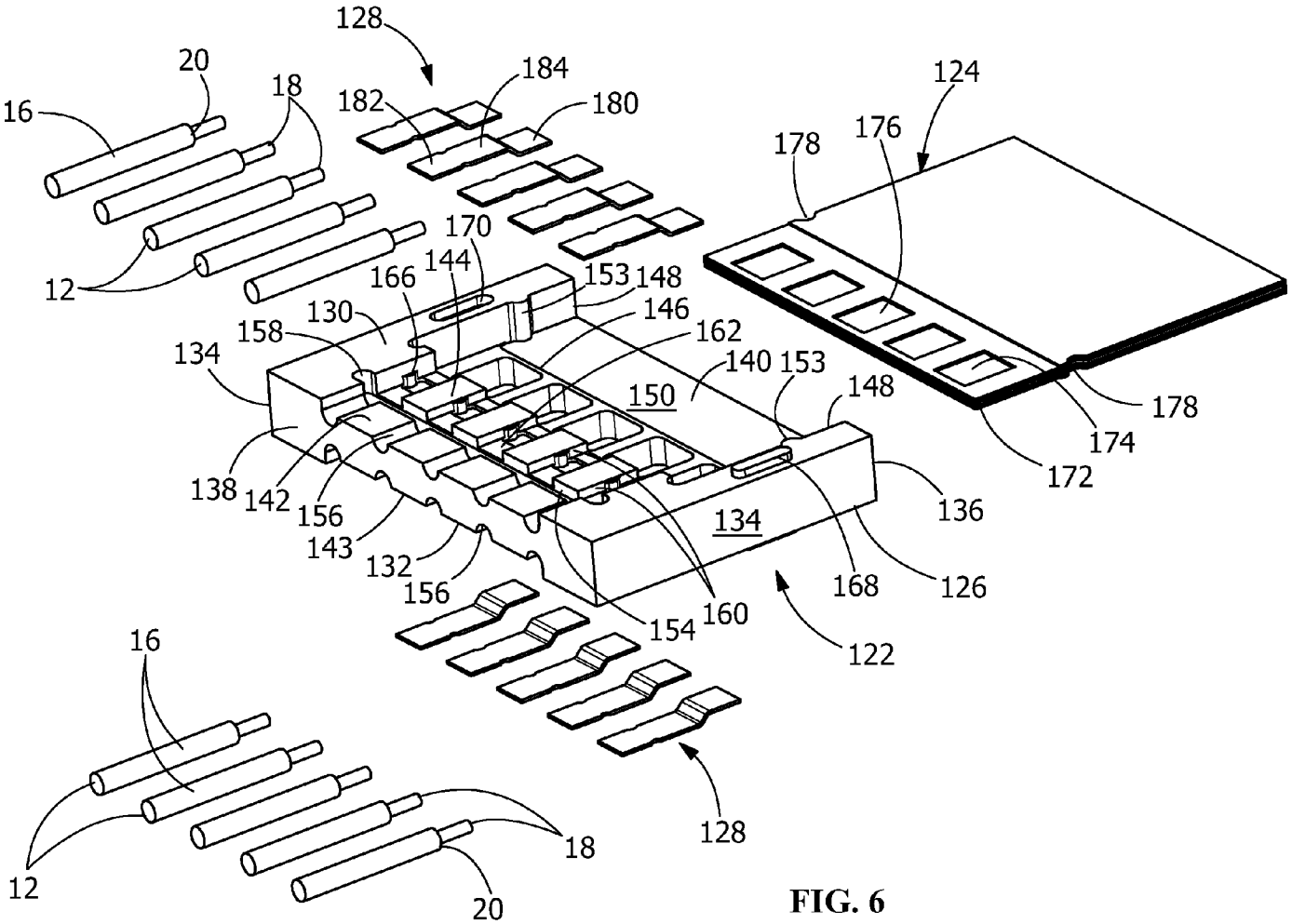
FIG. 6 is a perspective view of the flexible circuit to wire transition member of FIG. 5 with a flexible circuit, wires and contacts exploded from a housing.
Figure 7:
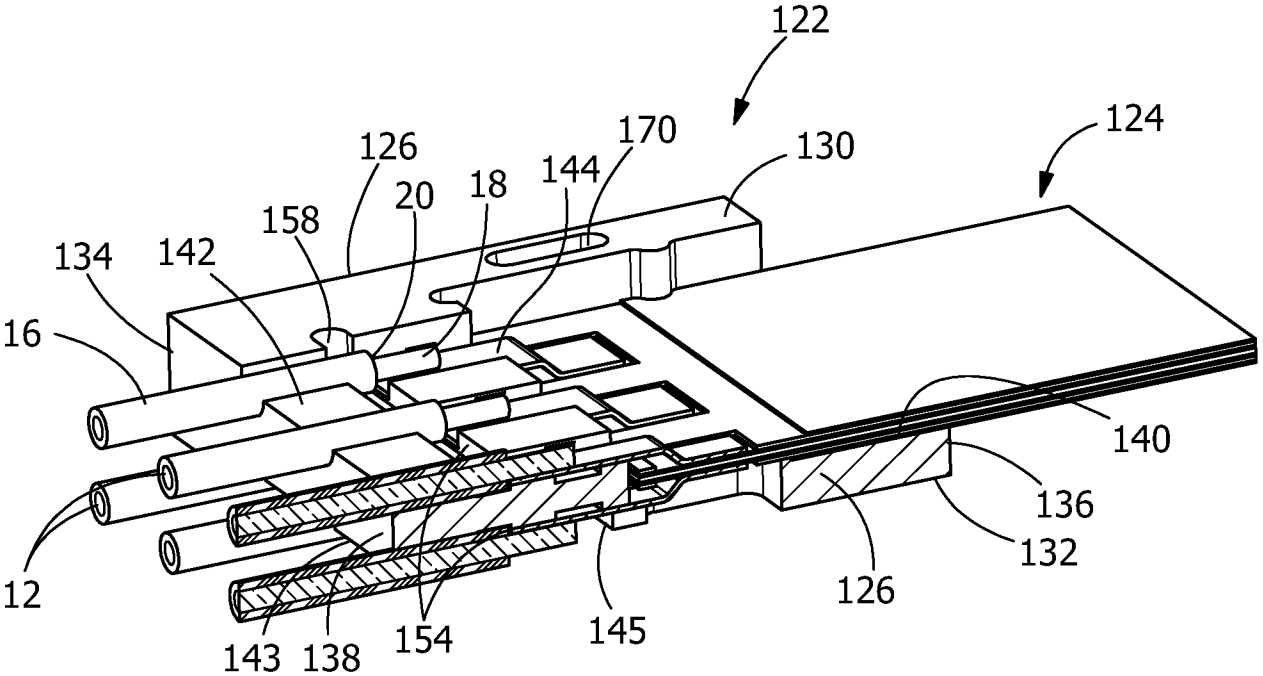
FIG. 7 is a perspective cross-sectional view of the flexible circuit to wire transition member taken along line 7-7 of FIG. 5.

Referring to FIGS. 5 through 7, transition member 122 provides a transition between the wires 12 and a flexible circuit 124, thereby allowing electrical signals to flow from the flexible circuit 124 across the transition member 122 to the wires 12 and to the terminals of the electrical connector 10. In the illustrative embodiment shown, the flexible circuit 124 is a multi-layer circuit with contact pads 174 provided on both sides of the flexible circuit 124.

Transition member 122 has a housing 126 with contacts 128 provided therein. As best shown in FIG. 6, the housing 126 has a top or first surface 130, an oppositely facing bottom or second surface 132, sidewalls 134, a flexible circuit receiving face 136 and a wire receiving face 138. The housing has flexible circuit receiving recesses 140, wire receiving recesses 142, 143 and contact receiving recesses 144, 145 which extend between the flexible circuit receiving recess 140 and the wire receiving recess 142, 143.

The flexible circuit receiving recess 140 extends from the flexible circuit receiving face 136 toward the wire receiving face 138, and extends from the first surface 130 toward the second surface 132. The flexible circuit receiving recess 140 has a front surface 146, side surfaces 148 and a bottom surface 150. The front surface 146, side surfaces 148 and bottom surface 150 cooperate with flexible circuit 124 to properly position the flexible circuit 124 in the flexible circuit receiving recess 140 and in the housing 126 of the transition member 122. Flexible circuit retention members 153 extend from the side surfaces 148 into the flexible circuit receiving recess 140.

The wire receiving recesses 142 extend from the wire receiving face 138 toward the flexible circuit receiving face 136, and extend from the first surface 130 toward the second surface 132. The wire receiving recesses 143 extend from the wire receiving face 38 toward the flexible circuit receiving face 136, and extend from the second surface 132 toward the first surface 130. The wire receiving recesses 142, 143 have front surfaces 154 and arcuately shaped bottom surface 156. The front surfaces 154 and bottom surfaces 156 cooperate with wires 12 to properly position the wires in the wire receiving recesses 142, 143 and in the housing 126 of the transition member 122. In the embodiment shown, slots 158 are provided proximate the front surfaces 154 and extend across multiple wire receiving recesses 142, 143.

The contact receiving recesses 144 extend between the flexible circuit receiving recess 140 and the wire receiving recess 142, and extend from the first surface 130 toward the second surface 132. The contact receiving recesses 145 extend between the flexible circuit receiving recess 140 and the wire receiving recess 143, and extend from the second surface 132 toward the first surface 130. The contact receiving recesses 144, 145 have side surfaces 160 and bottom surfaces 162. The side surfaces 160 and bottom surfaces 162 cooperate with contacts 128 to properly position the contacts 128 in the contact receiving recesses 144, 145 and in the housing 126 of the transition member 122. Contact retention members 166 extend from the side surfaces 160 into the contact receiving recesses 144, 145. The bottom surfaces 162 of the contact receiving recesses 144, 145 are raised relative to the bottom surface 156 of the wire receiving recesses 142, 143.

A transition member stacking projection 168 extends from the first surface 130 in a direction away from the second surface 132. A transition member stacking recess 170 extends from the first surface 130 in a direction toward the second surface 132.

Flexible circuit 124 has a mating end 172 with contact pads 174 of traces exposed through windows or cut outs 176. The contact pads 174 are exposed using laser ablation, micro-machining or other known methods. Retention member receiving recesses 178 are provided proximate the mating end 172.

Contacts 128 are made from any material having the conductive and strength characteristics required. Each contact 128 has a flexible circuit engagement portion 180, a wire engagement portion 182 and a transition portion 184. As the contact pads 174 of the flexible circuit 124 may have centerline spacing which is different from the centerline spacing of the wires 12, the each transition portion 184 may be configured differently to accommodate such spacing differences. The flexible circuit engagement portions 180 of the contacts 128 may also be positioned at different heights or in different horizontal planes to accommodate the different heights of the contact pads 174 of the flexible circuit which are used for grounding or the like.

Referring to FIGS. 5 and 7, when assembled, the flexible circuits 124 are positioned in the flexible circuit receiving recess 140 and are prevented from axial movement by the cooperation of the flexible circuit retention members 153 with the retention member receiving recesses 178. Contacts 128 are positioned in the flexible contact receiving recesses 144, 145 and are prevented from axial movement by the cooperation of the contact retention members 166 with the transition portion 184. The flexible circuit engagement portion 180 are electrically and mechanically connected to the contact pads 174 by solder, laser welding or other know methods.

The wires 12 are positioned in the wire receiving recesses 142, 143. The ends of the insulation 16 abut the front surfaces 154 to properly position the wires 12 in the wire receiving recesses 142, 143. The conductors 18 of the wires 12 are electrically and mechanically connected to the contact engagement portions 182 by solder, laser welding or other know methods.

With the wires 12 and flexible circuit 124 properly connected to the contacts 128, a potting compound is applied to the flexible circuit receiving recesses 140, the wire receiving recesses 142, 143 and the contact receiving recesses 144, 145 to properly secure the components in position and to properly seal the transition member 122. Alternatively, overmolding or other similar techniques may be applied to seal the transition member 122 and maintain the components in position.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A flexible circuit to wire transition member, the transition member comprising:

a housing;

a flexible circuit receiving recess provided in the housing proximate a first surface of the housing;

a wire receiving recess provided in the housing proximate the first surface of the housing;

a contact positioned in a contact receiving recess, the contact extending between the flexible circuit receiving recess and the wire receiving recess, the contact provides an electrical connection between a flexible circuit received in the flexible circuit receiving recess and a wire received in the wire receiving recess;

a compound provided in the flexible circuit receiving recess, the wire receiving recess and the contact receiving recess to retain the flexible circuit, wire and contact in position relative to the housing and to provide insulation and sealing.

2. The transition member as recited in claim 1, wherein the housing has multiple wire receiving recesses for receiving multiple wires therein.

3. The transition member as recited in claim 1, wherein the contact receiving recess extends between the flexible circuit receiving recess and the wire receiving recess, the contact receiving recess is configured to receive the contact therein.

4. The transition member as recited in claim 3, wherein the housing has multiple contact receiving recesses for receiving multiple contacts therein.

5. The transition member as recited in claim 4, wherein the contact receiving recesses proximate the flexible circuit receiving recess are spaced apart a first distance and the contact receiving recesses proximate the wire receiving recess are spaced apart a second distance, the first distance being different than the second distance.

6. The transition member as recited in claim 3, wherein the contact receiving recess is raised or lowered relative to the wire receiving recess, a wall extends between the contact receiving recess and the wire receiving recess, the wall cooperates with an insulation jacket positioned about the wire to properly position the wire in the housing.

7. The transition member as recited in claim 3, wherein the contact receiving recess has one or more projections which extend into the contact receiving recess to properly position and retain the contact in the contact receiving recess.

8. The transition member as recited in claim 1, wherein the flexible circuit receiving recess has one or more projections which extend into the flexible circuit receiving recess to properly position and retain the flexible circuit in the flexible circuit receiving recess.

9. The transition member as recited in claim 1, wherein the flexible circuit is a multi-layer circuit with contact pads provided on both sides of the flexible circuit.

10. The transition member as recited in claim 1, wherein stacking members are provided on the housing, the stacking members cooperate with stacking members provided on a housing of another transition member to allow the housings of the transition members to be joined.

11. A method of terminating a connector to a flexible circuit, the method comprising:

terminating wires to contacts in a connector;

positioning the wires in wire receiving recesses of a housing of a transition member, the housing having contacts in the transition member extending between the wire receiving recesses and a flexible circuit receiving recess;

positioning the flexible circuit in the flexible circuit receiving recess;

terminating the wires to the contacts in the transition member;

terminating the flexible circuit to the contacts in the transition member;

stacking multiple transition members;

providing electromagnetic shielding to the stacked multiple transition members;

wherein the electrical signals are directed between the wires and the flexible circuit through the contacts in the transition member of the transition member.

12. The method as recited in claim 11, comprising:

terminating the wires and flexible circuit to the contacts in the transition member by soldering.

13. The method as recited in claim 11, comprising:

terminating the wires and flexible circuit to the contacts in the transition member by laser welding.

14. The method as recited in claim 11, comprising:

overmolding the contacts in the transition member.

15. The method as recited in claim 11, comprising:

positioning potting compound in the wire receiving recesses and the flexible circuit receiving recess to retain the wires and flexible circuit in the housing.

16. The method as recited in claim 11, comprising:

exposing contact pads on the flexible circuit by laser ablation, micro-milling, or both.

17. The method as recited in claim 11, comprising:

securing the stacked multiple transition member together.

18. A multiple layer flexible circuit to wire transition member, the transition member comprising:

a housing;

a flexible circuit receiving recess provided in the housing proximate a first surface of the housing;

a first wire receiving recess provided in the housing proximate the first surface of the housing;

a second wire receiving recess provided in the housing proximate a second surface of the housing;

first contacts extending between the flexible circuit receiving recess and the first wire receiving recess, the first contacts provide an electrical connection between the multiple layer flexible circuit received in the flexible circuit receiving recess and first wires received in the first wire receiving recess;

second contacts extending between the flexible circuit receiving recess and the second wire receiving recess, the second contacts provide an electrical connection between the multiple layer flexible circuit received in the flexible circuit receiving recess and second wires received in the second wire receiving recess.

* * * * *